US006668739B1

(12) United States Patent
Chen

(10) Patent No.: US 6,668,739 B1
(45) Date of Patent: Dec. 30, 2003

(54) SEWING MACHINE

(75) Inventor: Shih-Fang Chen, Taipei (TW)

(73) Assignee: Ching Chi Machine Co., Ltd., Taipei Hsien (TW)

( * ) Notice: Subject to any disclaimer, the term of this patent is extended or adjusted under 35 U.S.C. 154(b) by 0 days.

(21) Appl. No.: 10/303,959

(22) Filed: Nov. 26, 2002

(51) Int. Cl.[7] ..... D05B 49/04
(52) U.S. Cl. ..... 112/248
(58) Field of Search ..... 112/241, 248, 112/249, 246, 220

(56) References Cited

U.S. PATENT DOCUMENTS 2,186,534 A * 1/1940 Le Vesconte ..... 112/248
4,444,138 A * 4/1984 Yamazawa ..... 112/241
6,213,039 B1 * 4/2001 Kawahito et al. ..... 112/273
6,263,812 B1 * 7/2001 Chen ..... 112/248

* cited by examiner

*Primary Examiner*—Ismael Izaguirre
(74) *Attorney, Agent, or Firm*—Rosenberg, Klein & Lee

(57) ABSTRACT

A sewing machine includes a first and a second lower rotary shafts coaxially coupled with each other by a shaft and disposed in a lower housing of the sewing machine. A looper thread take-up cam includes a first and a second take-up cam plates slidably key-fitted on the second lower rotary shaft. A slide interval is defined between the take-up structure and the shaft coupler, whereby the second cam plate can slide along the second lower rotary shaft to the slide interval and separate from the first cam plate for easily clearing up the tangling thread. A guide plate of the take-up structure is movably connected with a bracket of the lower housing, whereby by means of changing the position of the guide plate relative to the second lower rotary shaft, the take-up timing can be adjusted.

10 Claims, 15 Drawing Sheets

PRIOR ART 1

PRIOR ART 1

PRIOR ART 1

PRIOR ART 1

PRIOR ART 1

PRIOR ART 1

PRIOR ART 2

PRIOR ART 2

PRIOR ART 2

SEWING MACHINE

BACKGROUND OF THE INVENTION

1. Field of the Invention

The present invention is related to an improved sewing machine, and more particularly to an improved looper thread take-up structure of a sewing machine.

2. Description of the Prior Art

In sewing operation of a sewing machine, the take-up mechanism loosens the looper thread once in each stitch so as to automatically feed the thread and adjust the tension of the looper thread.

FIGS. 11 to 16 show a first type of conventional looper thread take-up structure 78 including a thread guide 79 and a take-up cam 84 both hidden in a lower housing 72 of the sewing machine. A first lower rotary shaft 73 is disposed in the lower housing 72 which is directly driven to further drive a second lower rotary shaft 74 via a shaft coupler 75. The take-up cam 84 is fitted on the second lower rotary shaft 74 and rotatable along with the first lower rotary shaft 73.

Referring to FIGS. 11, 15 and 16, the thread guide 79 has a guide plate 80 formed with a slot 81 and two eyelets 82, 83 respectively disposed on two sides of the slot 81. Two guide members 86, 87 are respectively locked on two sides of the slot 81 by screws 88. Via a screw 94, L-shaped coupling seat 105, screw 106, fixing seat 104 and screw 98, the guide plate 80 is locked in the lower housing 72. Each guide member 86, 87 has an eyelet 82, 83. The thread guide 79 includes a guide bar 85. One end of the guide bar 85 is locked on one end of the guide plate 80 via a screw 95, coupling seat 103 and screw 97. The other end of the guide bar 85 is extended into a fissure 91 between two cam plates 89, 90 of the take-up cam 84 and bridged over the other end of the guide plate 80. The guide bar 85 has a guide slot 92 for guiding the looper thread 93 to pass therethrough (also referring to FIG. 14).

Please refer to FIGS. 11, 15 and 16. The take-up cam 84 is composed of two cam plates 89 & 90 which have identical shape and are welded into one piece. The two cam plates 89, 90 are spaced by a small diameter spacer wheel to define the fissure 91. The end of the guide bar 85 is extended into the fissure 91.

Referring to FIG. 14, after the looper thread 93 is passed through the eyelet 83, the looper thread 93 is further passed through the lower knotting hook 101 as shown in FIG. 14. The lower knotting hook 101 cooperates with an upper stitching needle 77 and an upper knotting hook 100 in sewing operation.

Referring to FIGS. 11, 12, 14, 15 and 16, when the take-up cam 84 is rotated along with the second lower rotary shaft 74, by means of the outer circumference of the take-up cam 84, the thread is loosened in sewing operation.

Referring to FIGS. 11 to 16, the first type of conventional looper thread take-up structure 78 is fixed on the second lower rotary shaft 74. Accordingly, once the thread breaks, the take-up cam 84 in the looper thread take-up structure 78 will continuously rotate to make the thread head tangle between the cam plates 89, 90 welded together. The take-up cam 84 is fixed in the lower housing 72 and is undetachable. Moreover, there is no room between the looper thread take-up structure 78 and the shaft coupler 75. Therefore, it is necessary to use a very thin artistic knife to clear up the tangling thread in a very narrow space. This is a task.

FIGS. 17 to 19 show a second type of conventional looper thread take-up structure 78 for solving the above problem.

The looper thread take-up structure 78 is mounted beside the column 76 of the upper housing 71 of the sewing machine 70. This makes it easier to detach the take-up cam 84 from the sewing machine. However, the two cam plates 89, 90 are still welded into one single piece. After the take-up cam 84 is detached, it is still difficult to clear up the tangling thread from the very narrow fissure of the take-up cam 84. (The width of the fissure is only 2 mm.) A very thin artistic knife can be extended into the very narrow fissure to cut off the tangling thread. However, when cutting off the tangling thread, the sharp blade often incautiously cuts the polished outer circumference of the take-up cam to form a notch. After the take-up cam is reassembled, such notch tends to cut off the thread. Therefore, it is unsafe to use the artistic knife to clear up the tangling thread.

In addition, no matter what tool is used, it is time-consuming to clear up the tangling thread. (It often takes half day or even one day to clear up the tangling thread.) During this period, the work must be stopped. This greatly affects the production. Therefore, it is necessary to solve the above problem.

U.S. Pat. No. 6,263,812 of this applicant discloses a looper thread take-up mechanism for solving the problem existing in the first type of conventional looper thread take-up structure shown by FIGS. 11 and 16. In the above Patent, the take-up cam is composed of a first cam plate and a second cam plate which are separable and detachable from the rotary shaft. In case the thread tangles, the first and second cam plates can be separated to quickly and easily clear up the tangling thread.

With respect to the second type of conventional looper thread take-up structure 78 shown by FIGS. 17 to 19, the take-up section starts from the looper thread take-up structure 78 and ends at the stroke position of the lower crochet needle. This take-up section is too long. That is because the looper thread take-up structure 78 is mounted on inner side of the column 76 and spaced from the stroke position of the lower crochet needle by a too long distance. It is known that the increased length of the looper thread in each take-up travel of the looper thread take-up structure 78 is limited. The longer the take-up section is, the less the looper thread is loosened. The take-up section of the second type of conventional looper thread take-up structure 78 is much longer than the take-up section of the first type of conventional looper thread take-up structure 78. In addition, the stitching thread is extensible. Therefore, the second type of conventional looper thread take-up structure 78 shown by FIGS. 17 to 19 has a take-up effect poorer than that of the first type of conventional looper thread take-up structure 78 shown by FIGS. 11 to 16.

The looper thread take-up mechanism of U.S. Pat. No. 6,263,812 of this applicant provides a measure for solving the problems existing in both the first and second types of conventional looper thread take-up structures 78. In the above Patent, the looper thread take-up mechanism is mounted on the lower driving shaft of the sewing machine without intervening with the sewing operation, while it is still easy to clear up the thread tangling between the two cam plates of the take-up cam.

Besides, referring to FIGS. 15 and 16, before released, the relative phase between the take-up cam 84 and the second lower rotary shaft 74 has been well adjusted by the manufacturer, that is, the timing of the take-up cam 84 has been set. However, the preset timing is not suitable for different kinds of sewing materials and stitching threads. Too early or too late take-up operation will affect the seam on the sewing material. The take-up cam 84 has been well adjusted by specialists before released from the factory. In the case that the garment manufacturers want to re-adjust the take-up cam 84 themselves, as shown in FIGS. 15 and 16, it is necessary to unscrew the screws 96 and 99.

However, referring to FIGS. 15 and 16, the problem is that the take-up cam 84 is fitted on the second lower rotary shaft 74 and locked thereon by screws 96 and 99. By means of unscrewing the screws 96 and 99, the take-up cam 84 can be turned relative to the second lower rotary shaft 74 so as to change the phase of the take-up cam 84 relative to the second lower rotary shaft 74. However, there is no reference for the turning angle. Therefore, it is necessary to repeatedly unscrew and screw the screws 96 and 99 and turn the take-up cam 84 to try the position. Therefore, the garment manufactures can hardly optimally adjust the take-up cam according to the variety of the sewing material and stitching thread.

In case the relative phase between the take-up cam 84 and the second lower rotary shaft 74 can be conveniently and accurately adjusted by the garment manufacturers themselves, an optimal sewing effect can be achieved.

SUMMARY OF THE INVENTION

It is therefore a primary object of the present invention to provide an improved sewing machine which is able to achieve the following purposes:

1. A slide interval is defined between the looper thread take-up structure and the shaft coupler. The first and second cam plates can slide along the second lower rotary shaft to the slide interval and respectively slide to two sides and separate from each other. Therefore, the tangling thread between the two cam plates can be easily cleared up.

2. A recess is formed on a portion of the second lower rotary shaft where the looper thread take-up structure is fitted. A tool can be extended into the recess to cut off the thread tangling around the second lower rotary shaft so as to more easily clear up the tangling thread.

3. The take-up structure of the present invention can be still mounted in the lower housing of the sewing machine in the original position. Therefore, the take-up structure is close to the lower knotting hook and a better take-up effect can be achieved.

4. The relative phase between the take-up cam and the second lower rotary shaft can be easily and quickly adjusted so as to achieve an optimal sewing effect.

5. Without any specialist skilled in sewing machine, a general sewer herself can easily quickly complete the adjustment.

According to the above object, the sewing machine of the present invention includes a lower housing, a first lower rotary shaft, a second lower rotary shaft, a shaft coupler and a looper thread take-up structure. The first lower rotary shaft is disposed in a section of the lower housing and drivingly connected with a power source. The second lower rotary shaft is disposed in another section of the lower housing and drivingly connected with a lower stitching needle. The second lower rotary shaft is coaxial with the first lower rotary shaft. The shaft coupler couples the first lower rotary shaft with the second lower rotary shaft, whereby the first lower rotary shaft and the second lower rotary shaft are drivingly connected to rotate along with each other. The looper thread take-up structure is fitted on the second lower rotary shaft. The looper thread take-up structure includes a thread guide and a take-up cam. The thread guide includes a guide plate formed with a slot and two eyelets respectively disposed on two sides of the slot. The take-up cam is fitted on the second lower rotary shaft and passed through the slot of the guide plate.

The take-up cam includes a first take-up cam plate and a second take-up cam plate. The first cam plate has an outer circumference and a shaft hole. By means of the shaft hole, the first cam plate is key-fitted on the second lower rotary shaft. The first cam plate is rotatable along with the second lower rotary shaft and axially slidable along the second lower rotary shaft. The second cam plate has an outer circumference and a shaft hole. By means of the shaft hole, the second cam plate is key-fitted on the second lower rotary shaft. The second cam plate is rotatable along with the second lower rotary shaft and axially slidable along the second lower rotary shaft. The first and second cam plates define therebetween a gap and are separable from each other for easily clearing up tangling thread. A slide interval is defined between the looper thread take-up structure and the shaft coupler, whereby the second cam plate can slide along the second lower rotary shaft to the slide interval and separate from the first cam plate for easily clearing up the tangling thread.

A recess is formed on a portion of the second lower rotary shaft where the looper thread take-up structure is fitted. A tool can be extended into the recess to cut off the thread tangling around the second lower rotary shaft.

The guide plate of the thread guide is movably connected with the lower housing. By means of changing the position of the guide plate relative to the second lower rotary shaft, the positions of the eyelets on two sides of the slot of the guide plate relative to the take-up cam are changeable so as to adjust the take-up timing.

The guide plate has a fixing slot. A bolt is passed through the fixing slot to lock the guide plate on the lower housing. By means of changing the position of the guide plate relative to the second lower rotary shaft, the positions of the eyelets on two sides of the slot of the guide plate relative to the take-up cam are changeable so as to adjust the take-up timing.

Scales are marked on one side of the fixing slot of the guide plate to indicate the position of the guide plate, whereby the take-up timing can be quickly and easily adjusted.

The lower housing is provided with a bracket having an arched guide section. The circular center of the arched guide section is positioned at the axis of the second lower rotary shaft. The guide plate is slidable along the arched guide section of the bracket. The eyelets on two sides of the slot of the guide plate revolve in an arched track about the axis of the second lower rotary shaft so as to adjust the take-up timing.

The present invention can be best understood through the following description and accompanying drawings wherein:

DETAILED DESCRIPTION OF THE PREFERRED EMBODIMENTS

Figure 1:
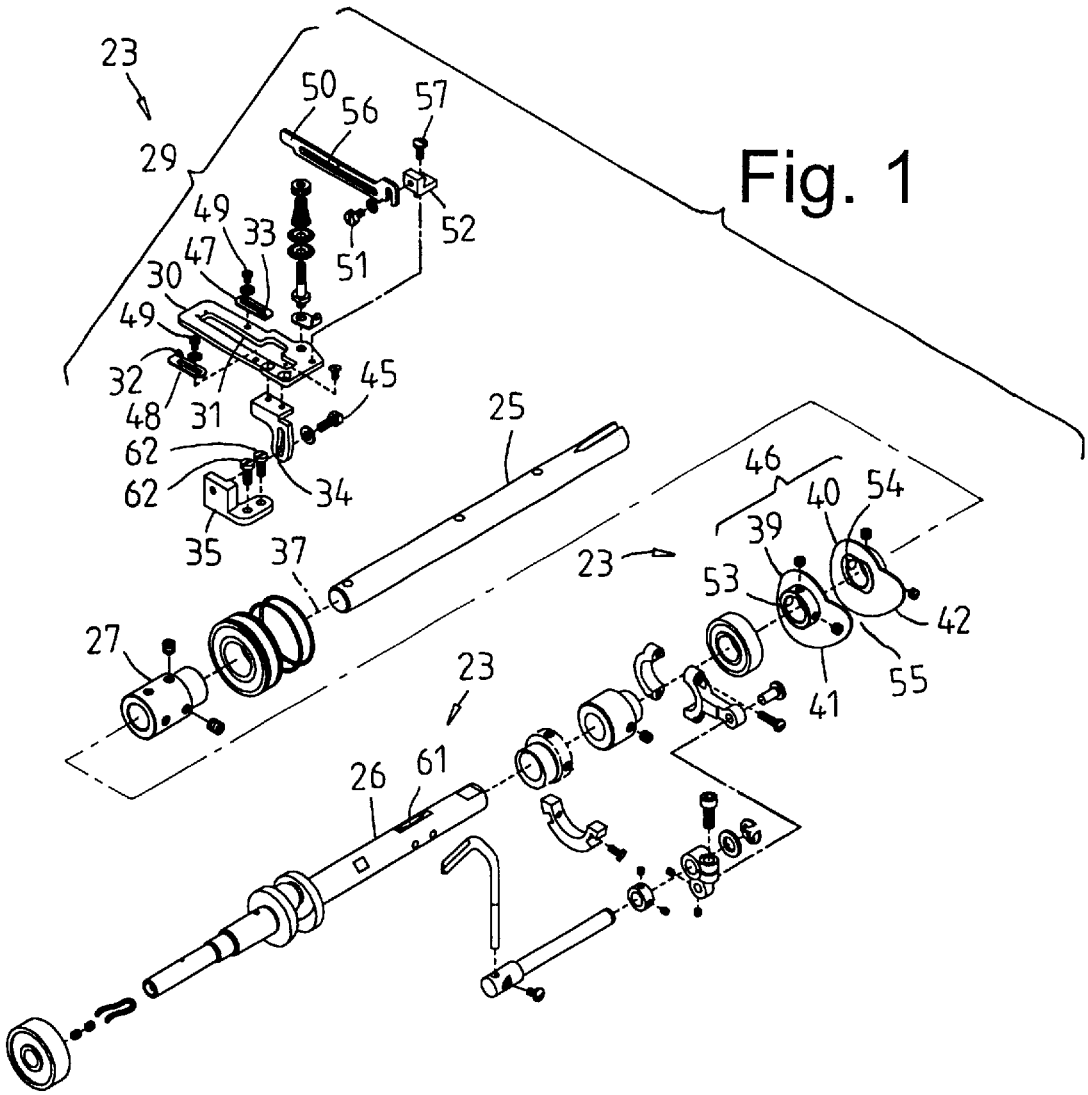
FIG. 1 is a perspective exploded view of the present invention.
Figure 2:
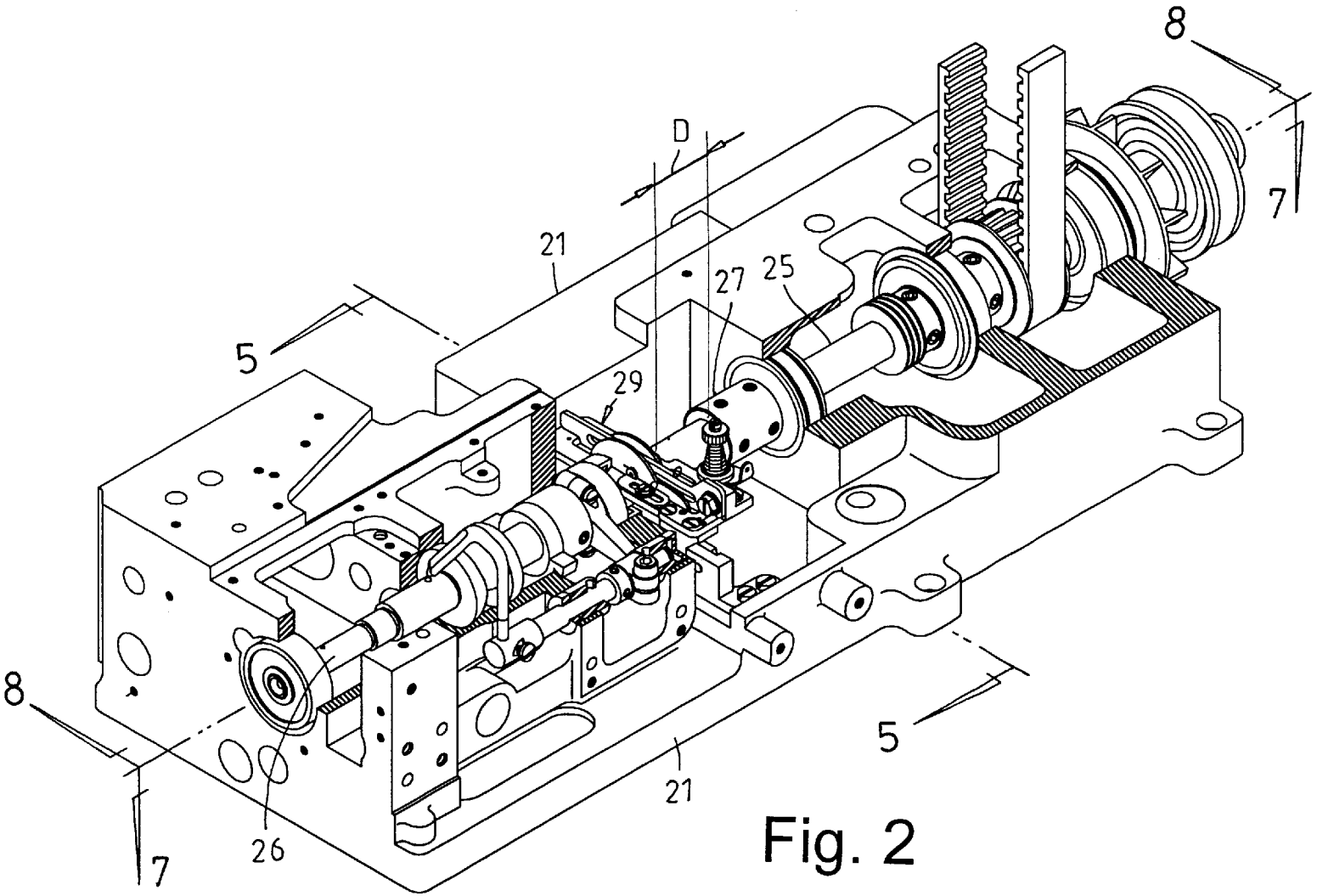
FIG. 2 is a perspective assembled view of the present invention mounted in the lower housing of the sewing machine.
Figure 3:
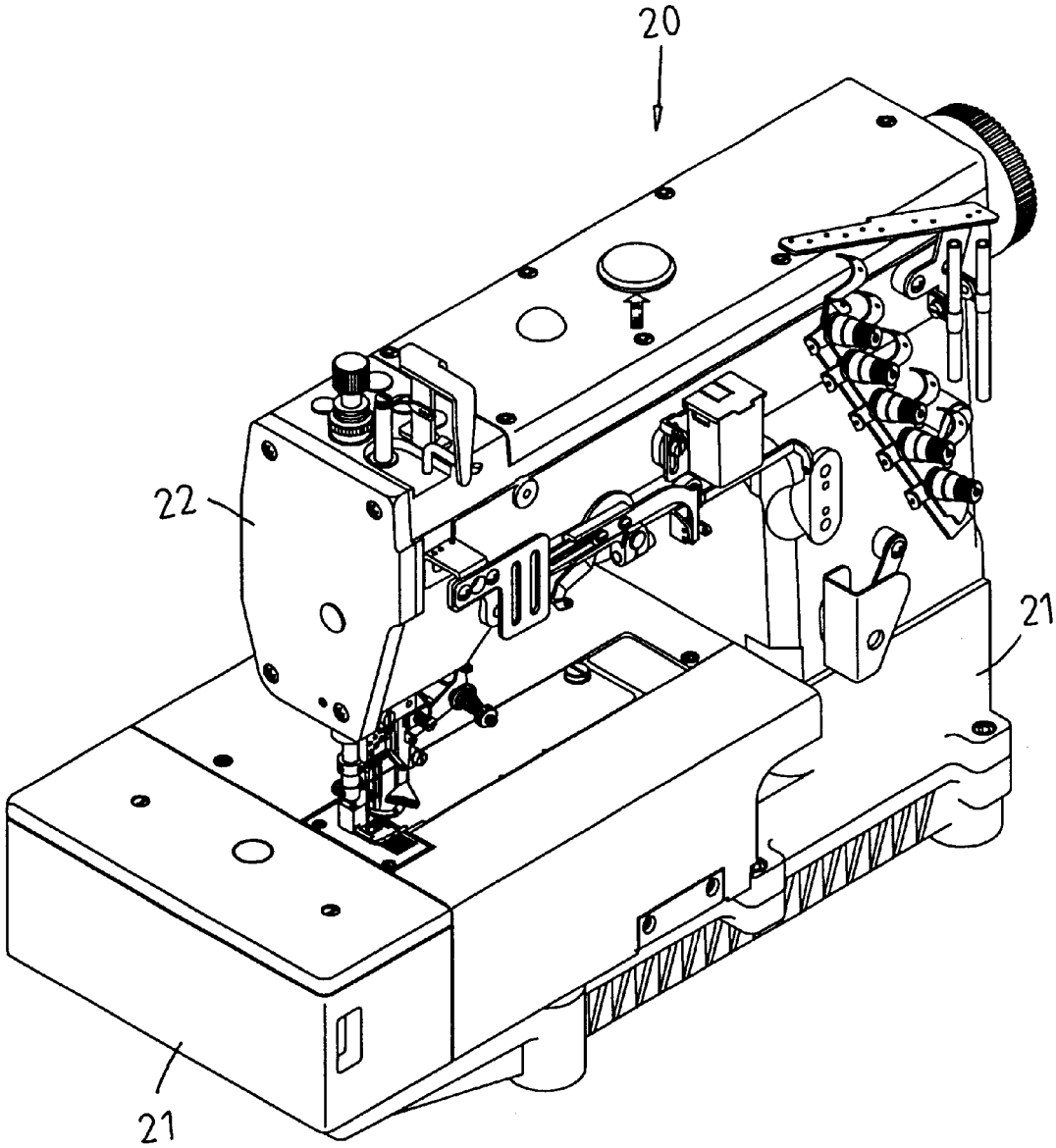
FIG. 3 is a perspective view of a common sewing machine in which the present invention is mounted.
Figure 4:
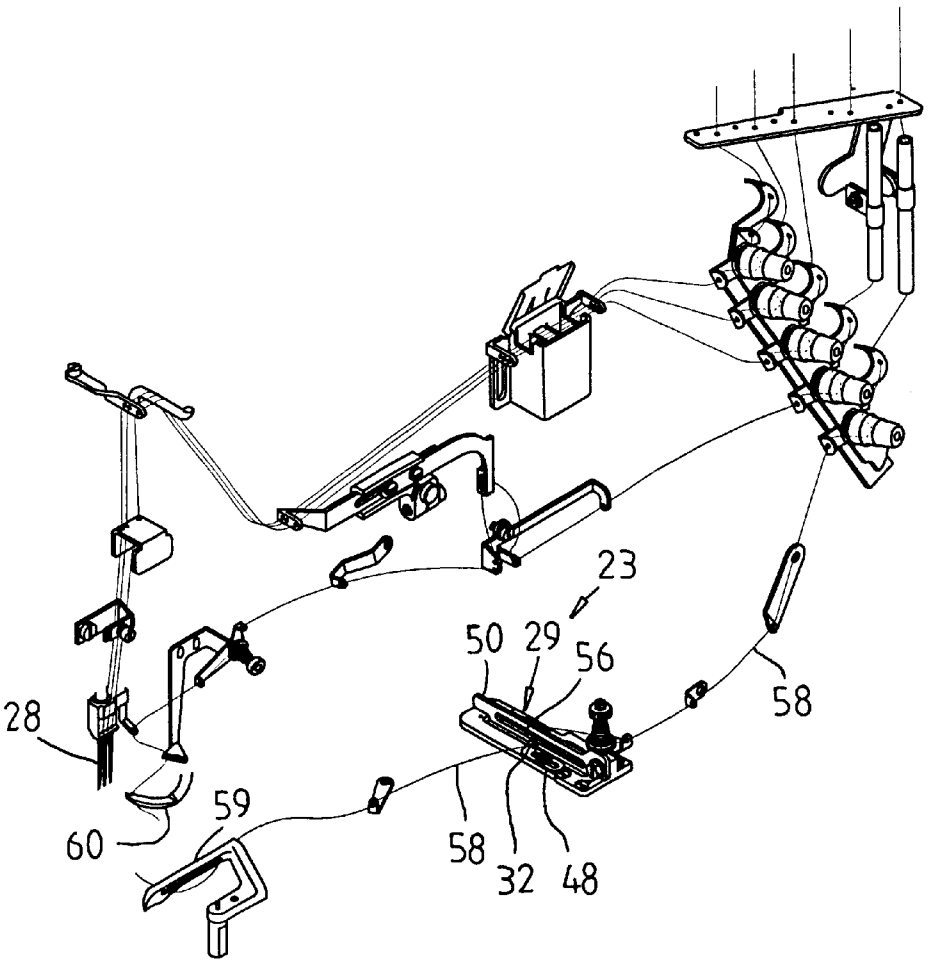
FIG. 4 shows the threading of the present invention.

Please refer to FIGS. 1 to 4. The sewing machine 20 of the present invention includes a lower housing 21, an upper housing 22, a first lower rotary shaft 25, a second lower rotary shaft 26 and a shaft coupler 27. The first lower rotary shaft 25 is disposed in the lower housing 21 and drivingly connected with a power source. The second lower rotary shaft 26 is also disposed in the lower housing 21 and coupled with the first lower rotary shaft 25 via the shaft coupler 27.

The looper thread take-up structure 23 is fitted on the second lower rotary shaft 26, including a thread guide 29 and a take-up cam 46. The thread guide 29 has a guide plate 30 formed with a slot 31 and two eyelets 32, 33 respectively disposed on two sides of the slot 31. The take-up cam 46 is fitted on the second lower rotary shaft 26 of the sewing machine 20 and passed through the slot 31 of the guide plate 30. Two guide members 47, 48 are respectively locked on two sides of the slot 31 of the guide plate 30 by screws 49. Each guide member 47, 48 has an eyelet 32, 33. The take-up cam 46 is upward passed through the slot 31 of the guide plate 30 from lower side thereof. The thread guide 29 further includes a guide bar 50. One end of the guide bar 50 is locked on one end of the guide plate 30 via a screw 51, coupling seat 52 and screw 57. The other end of the guide bar 50 is extended into a fissure 55 between two cam plates 39, 40 of the take-up cam 46 and bridged over the other end of the guide plate 30. The guide bar 50 has a guide slot 56 for guiding the looper thread 58 to pass therethrough to the lower knotting hook 59 (referring to FIG. 4). The lower knotting hook 59 cooperates with the upper stitching needle 28 and the upper knotting hook 60 to complete the sewing operation.

The present invention is characterized in that as shown in FIGS. 1 to 4, the looper thread take-up structure 23 is fitted on the second lower rotary shaft 26. The looper thread take-up structure 23 includes a first take-up cam plate 39 and a second take-up cam plate 40. The first cam plate 39 has an outer circumference 41 and a shaft hole 53. By means of the shaft hole 53, the first cam plate 39 is key-fitted on the second lower rotary shaft 26 and rotatable along therewith. In addition, the first cam plate 39 is axially slidable along the second lower rotary shaft 26. The second cam plate 40 has an outer circumference 42 and a shaft hole 54. By means of the shaft hole 54, the second cam plate 40 is key-fitted on the second lower rotary shaft 26 and rotatable along therewith. In addition, the second cam plate 40 is axially slidable along the second lower rotary shaft 26. The first and second cam plates 39, 40 define therebetween a cam plate gap G. Moreover, the first and second cam plates 39, 40 are separable from each other for easily clearing up the tangling thread.

Figures 9, 10:
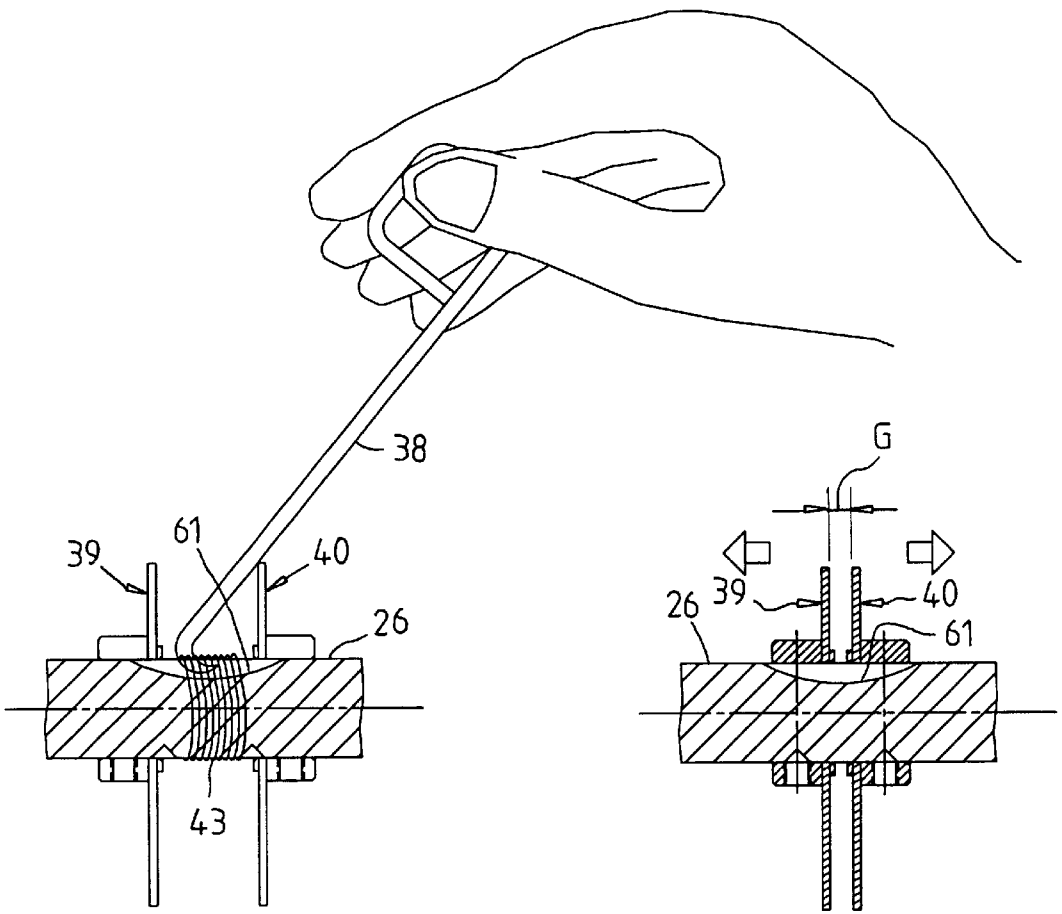
FIG. 9 shows that when clearing up the tangling thread, the two cam plates are moved to two sides in accordance with the present invention.
FIG. 10 shows that a tool is used to clear up the thread tangling around the second lower rotary shaft.
Figure 11:
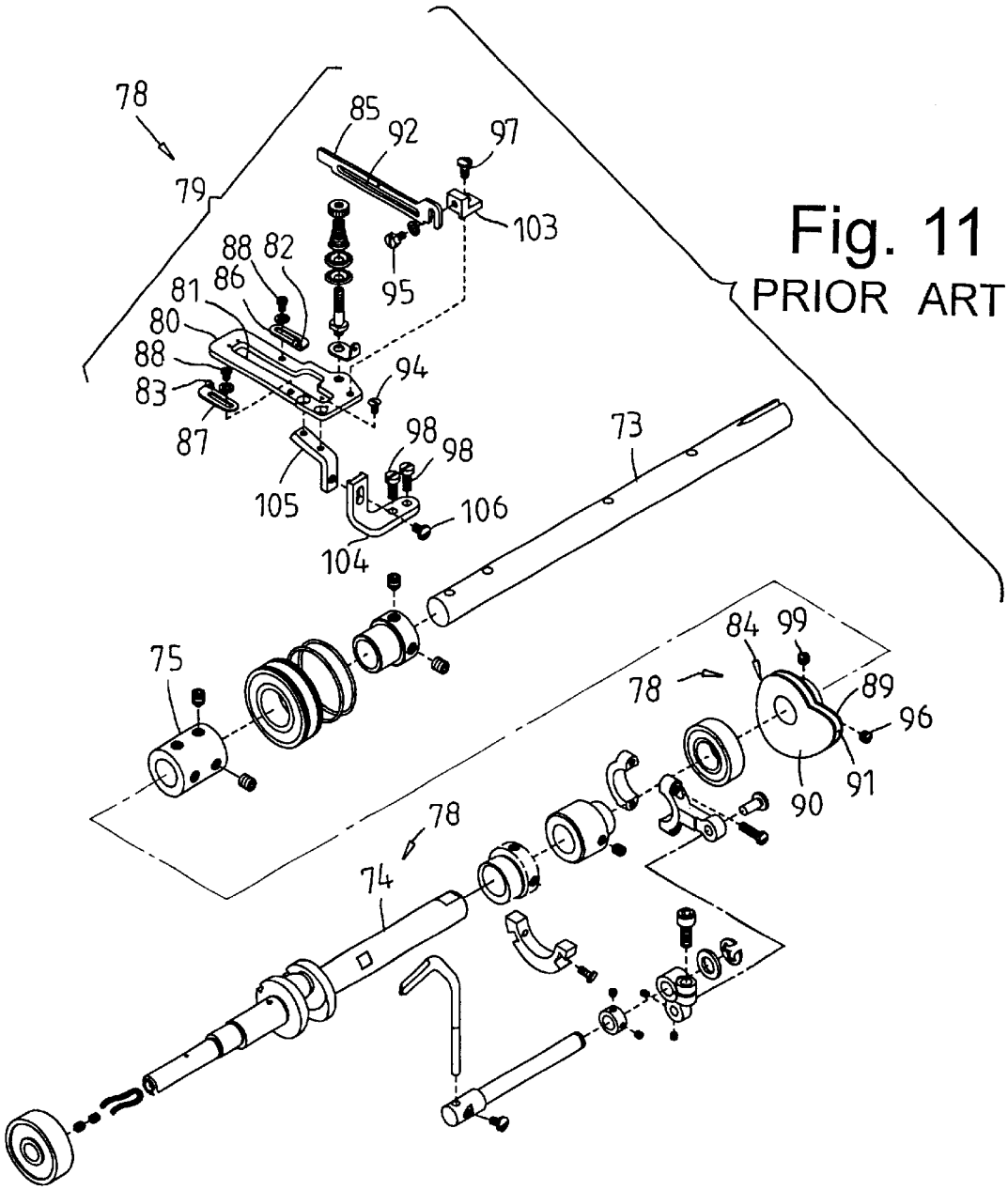
FIG. 11 is a perspective exploded view a conventional take-up structure of the prior art 1.
Figure 12:
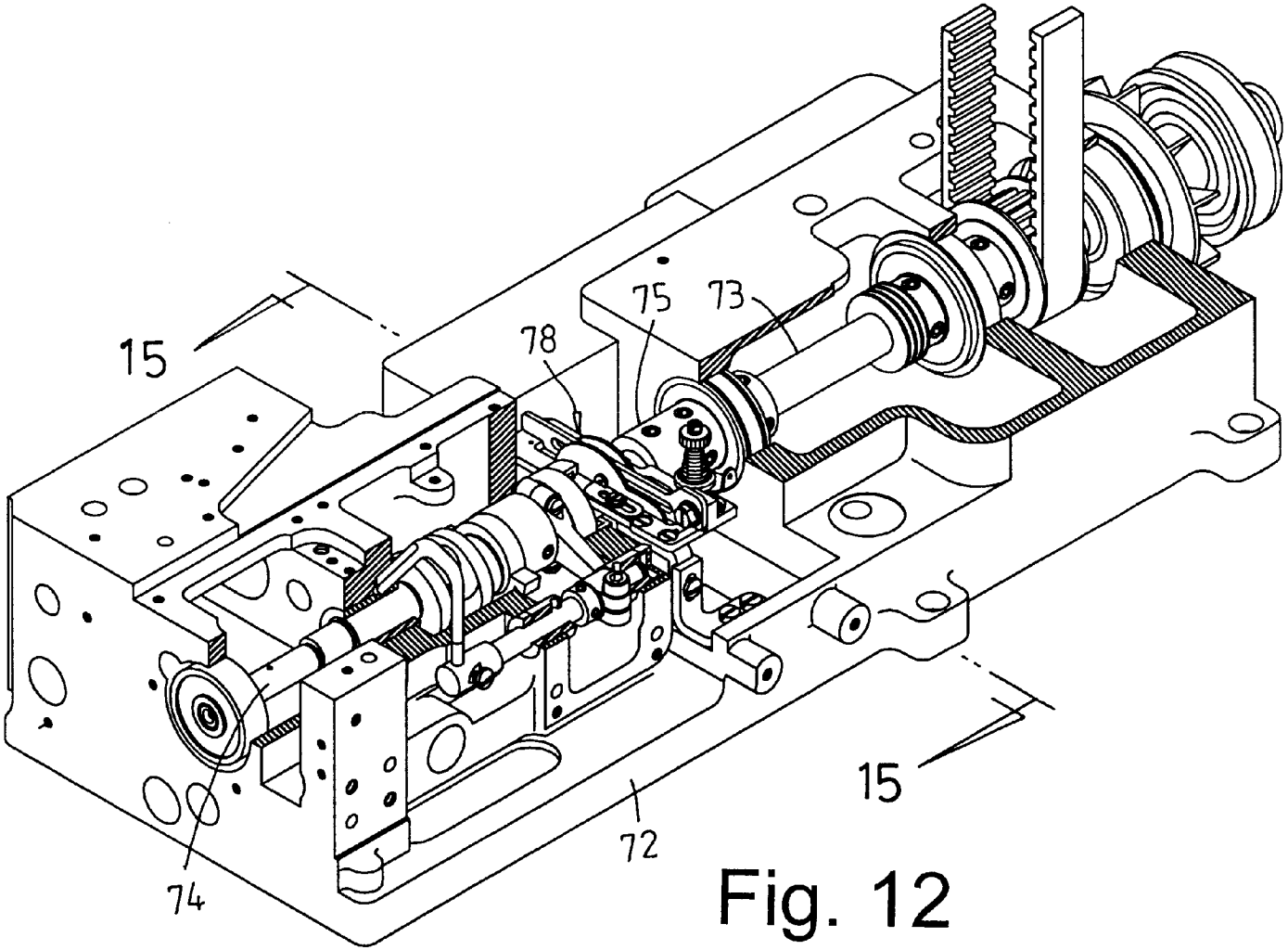
FIG. 12 is a perspective assembled view of the conventional take-up structure mounted in the lower housing of the sewing machine in accordance with the prior art 1.
Figure 13:
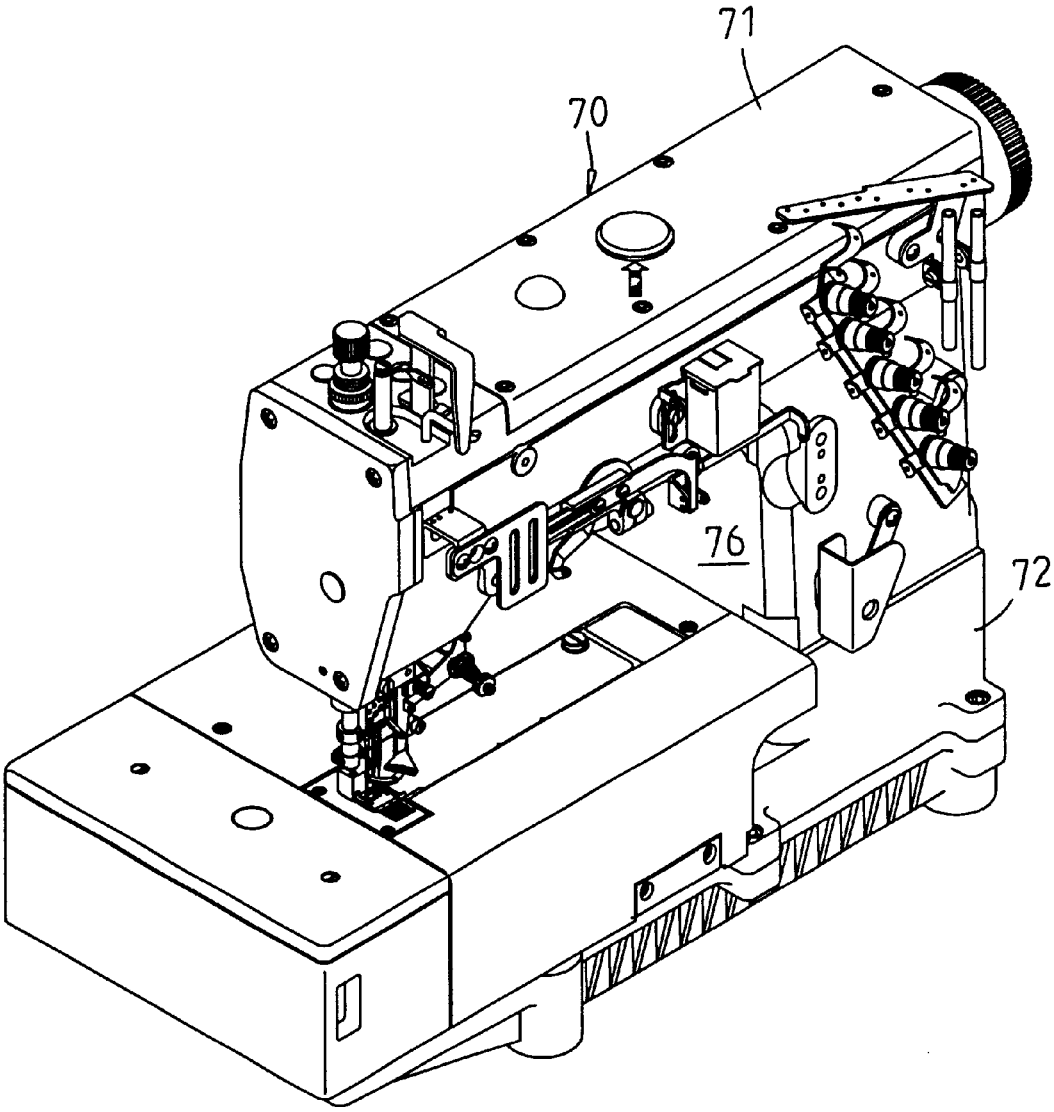
FIG. 13 is a perspective view of a common sewing machine in which the present invention is mounted in accordance with the prior art 1.
Figure 14:
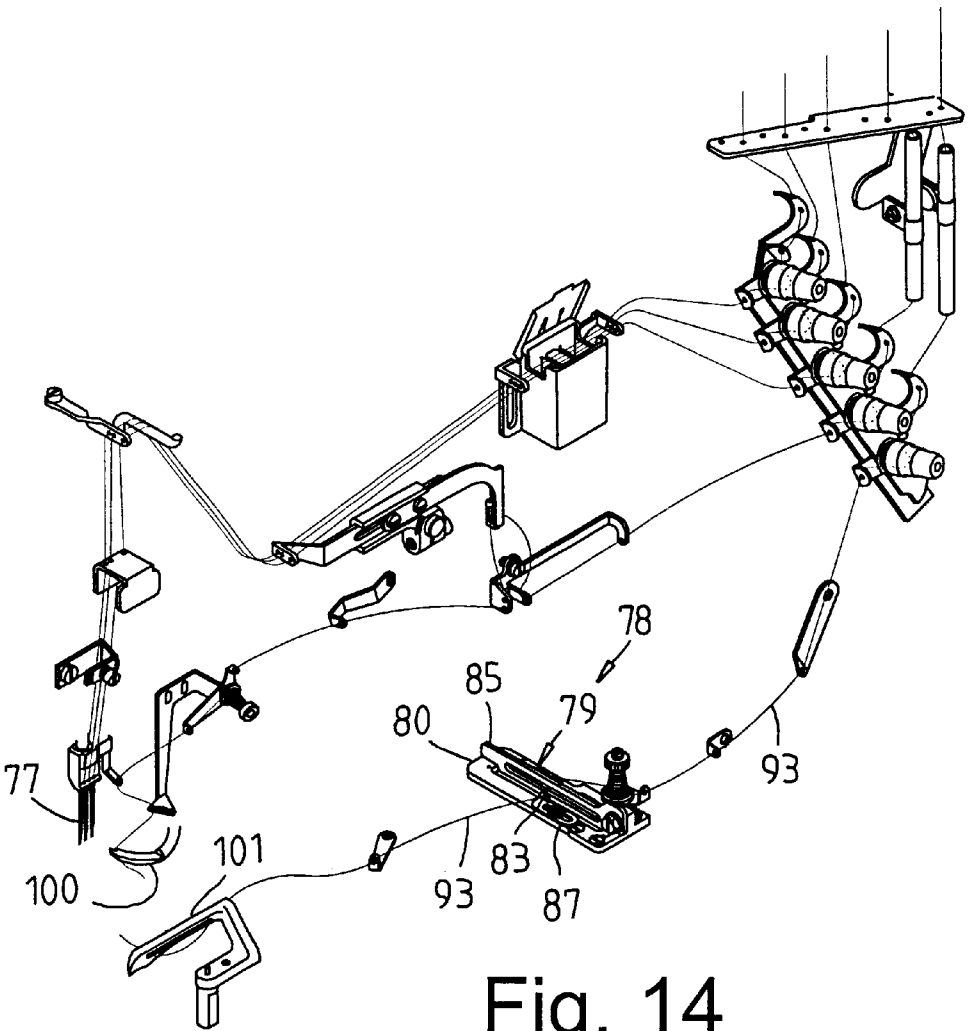
FIG. 14 shows the threading of the conventional take-up structure in accordance with the prior art 1.
Figure 15:
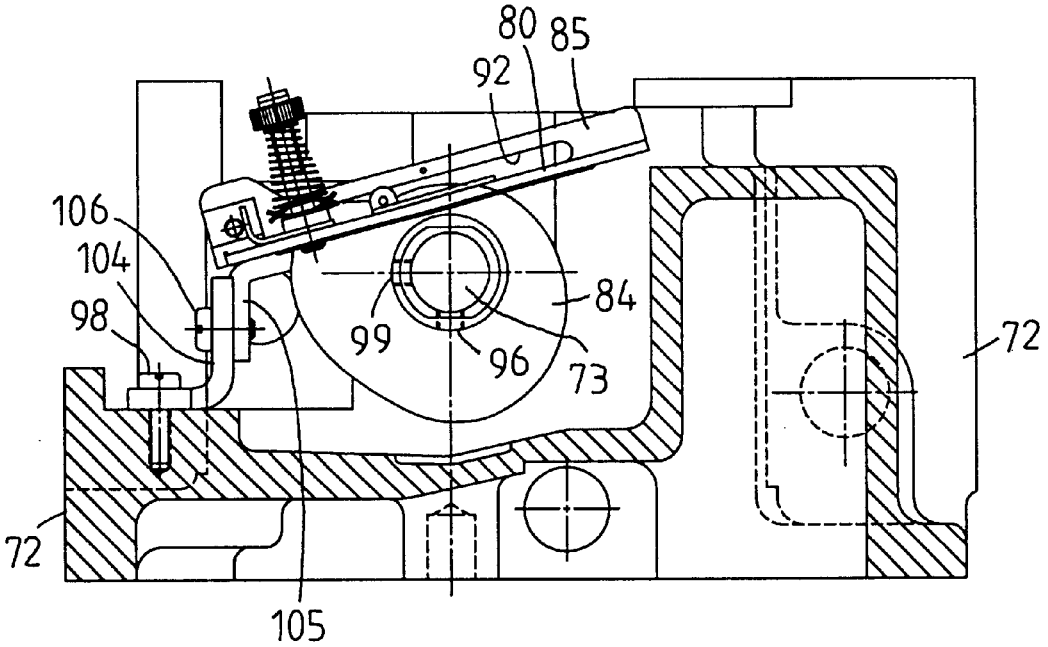
FIG. 15 is a sectional view taken along line 15—15 of FIG. 12, showing that the lower rotary shaft and the guide plate are positioned in a first position.
Figure 16:
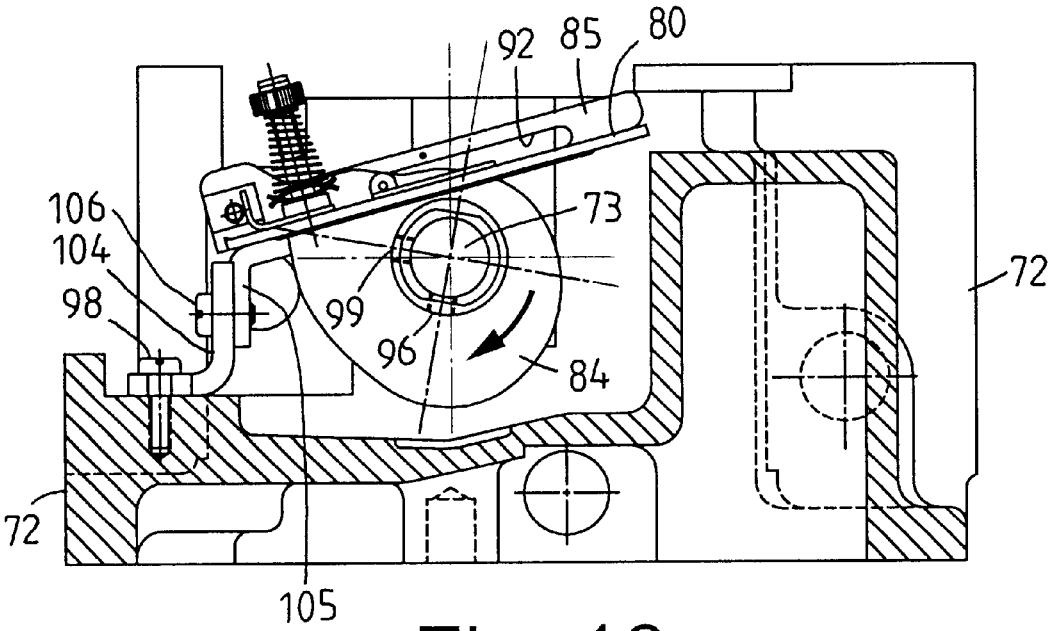
FIG. 16 is a view according to FIG. 15, showing that the lower rotary shaft must be moved to a second position for moving the guide plate to the second position.
Figure 17:
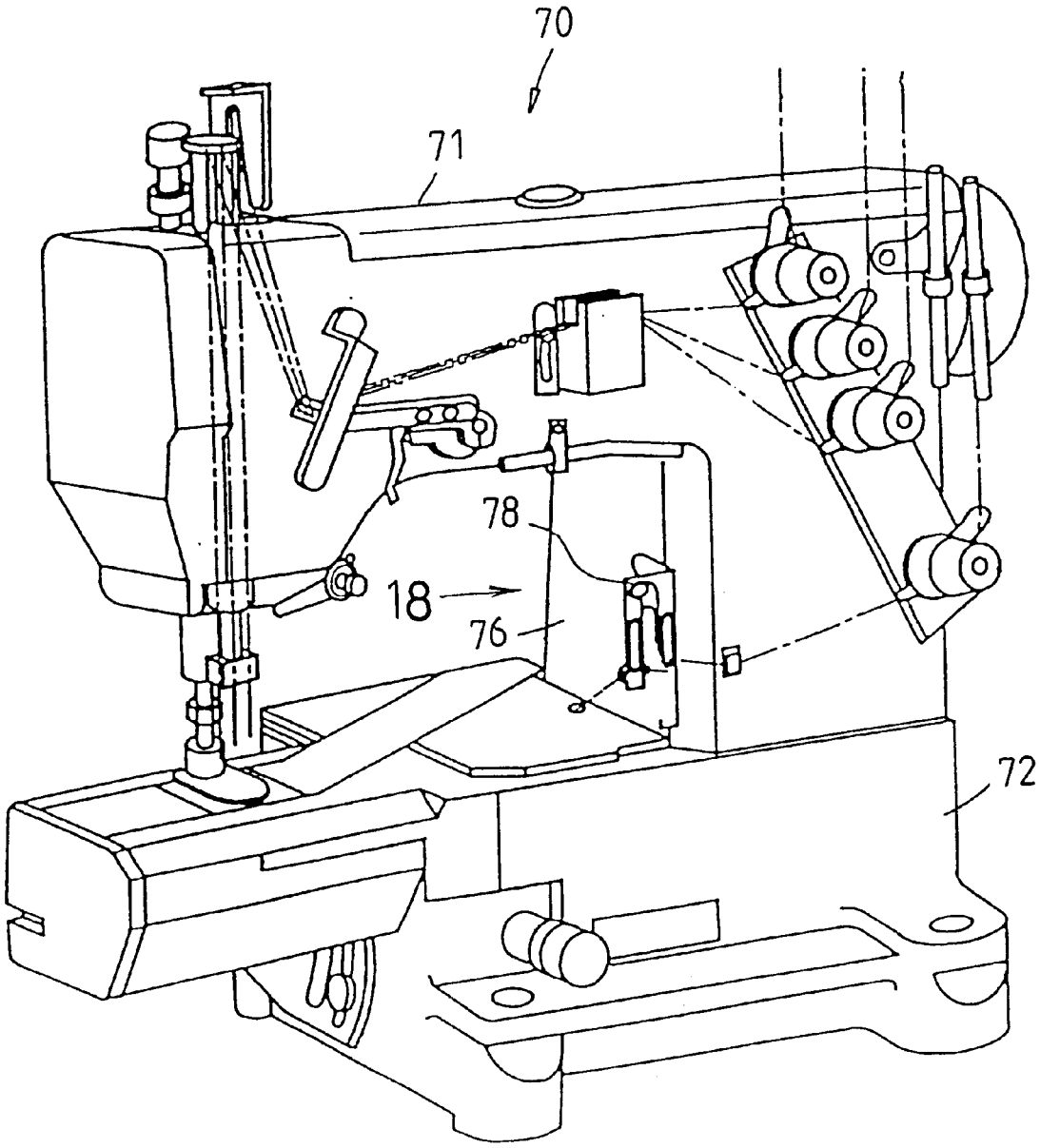
FIG. 17 is a perspective view of another type of conventional sewing machine of the prior art 2.
Figure 18:
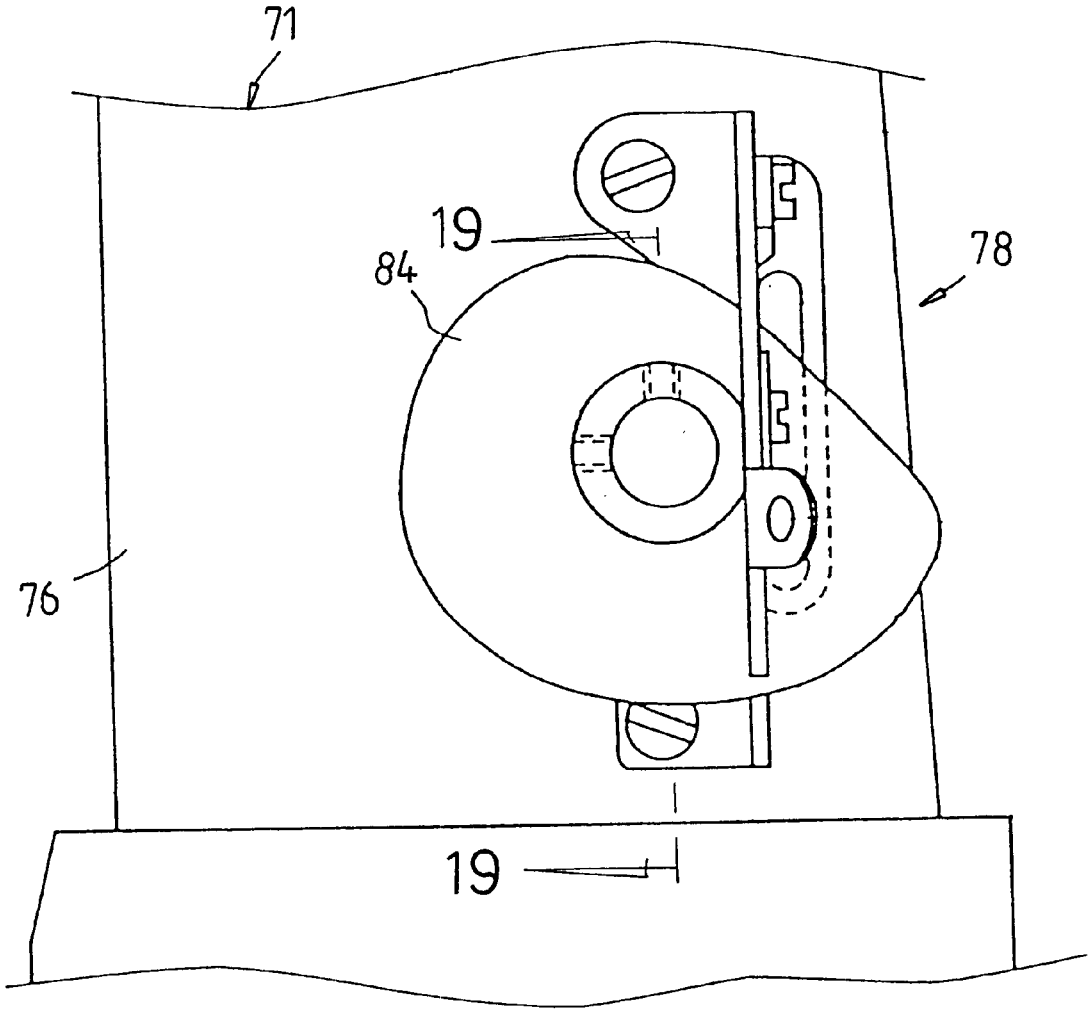
FIG. 18 is a view of a part of the conventional sewing machine of FIG. 17, seen in the direction of arrow 18.
Figure 19:
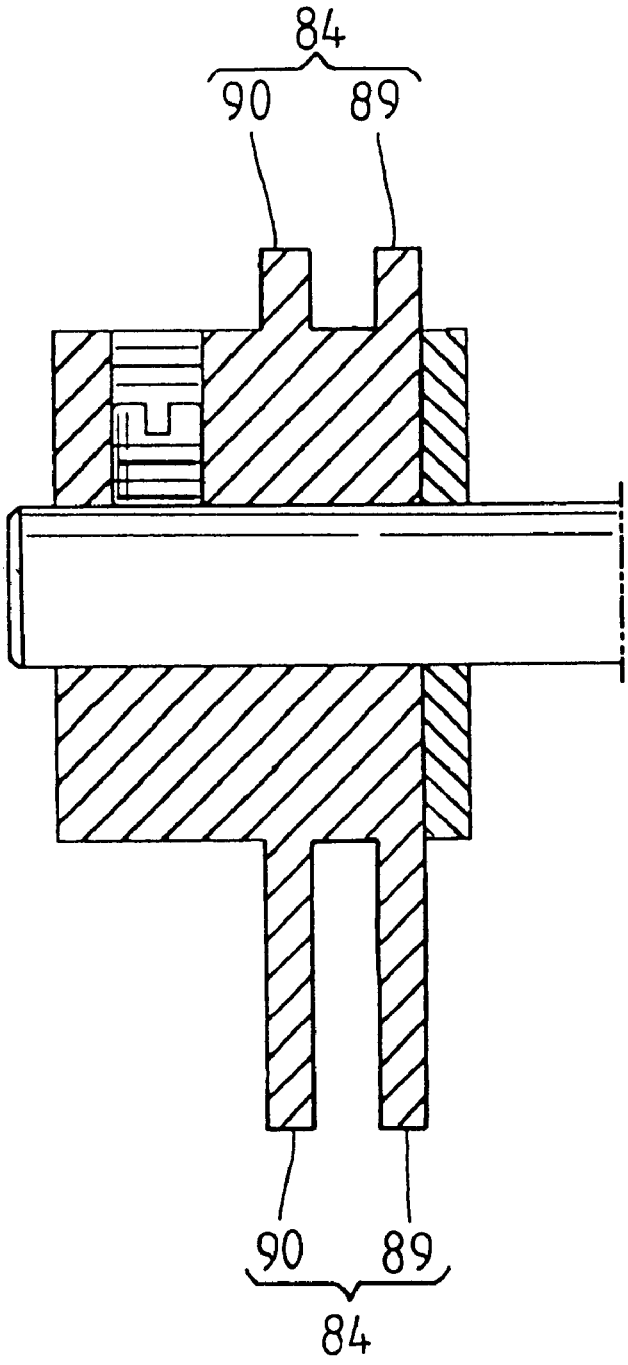
FIG. 19 is a sectional view taken along line 19—19 of FIG. 18.

Referring to FIGS. 2, 7, 8, 9 and 10, a slide interval D is defined between the looper thread take-up structure 23 and the shaft coupler 27. The first and second cam plates 39, 40 can slide along the second lower rotary shaft 26 to the slide interval D and respectively slide to two sides and separate from each other as shown in FIG. 10. This makes it easier to clear up the tangling thread.

Referring to FIGS. 1, 9 and 10, a recess 61 is formed on a portion of the second lower rotary shaft 26 where the looper thread take-up structure 23 is fitted. A tool 38 can be extended into the recess 61 to cut off the thread 43 tangling around the second lower rotary shaft 26.

Referring to FIGS. 1 to 4, the guide plate 30 of the thread guide 29 is movably connected with the lower housing 21. By means of changing the position of the guide plate 30 relative to the second lower rotary shaft 26, the positions of the eyelets 32, 33 on two sides of the slot 31 of the guide plate 30 relative to the take-up cam 46 are changeable so as to adjust the take-up timing.

Figure 5:
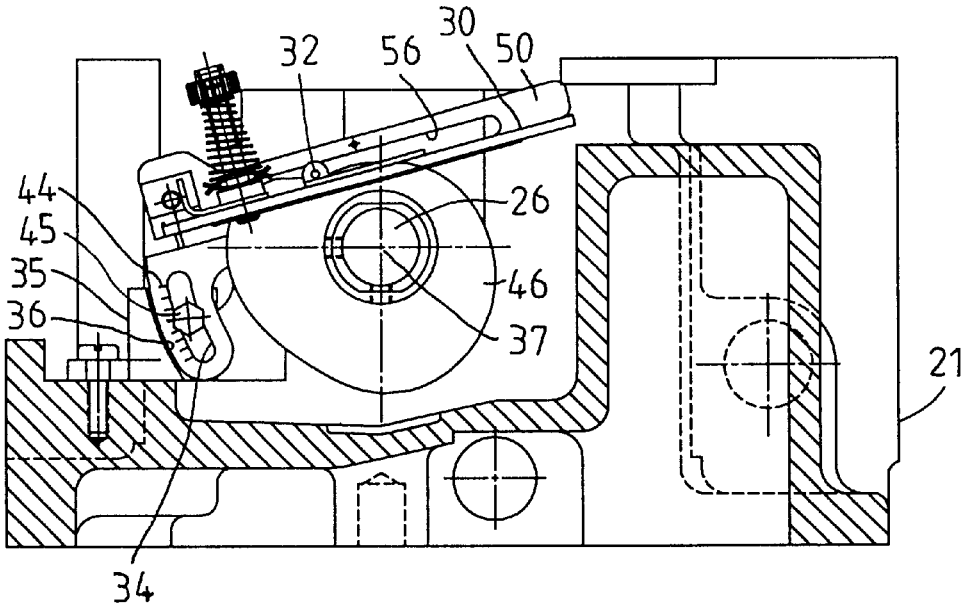
FIG. 5 is a sectional view taken along line 5—5 of FIG. 2.
Figure 6:
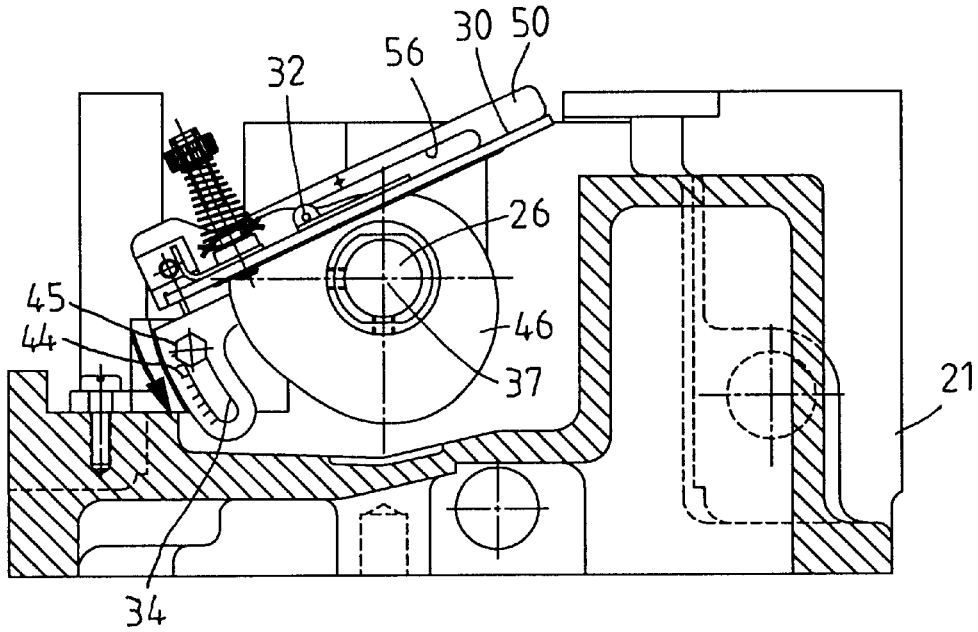
FIG. 6 is a view according to FIG. 5, in which the guide plate is adjusted from the first position of FIG. 5 to a second position.
Figure 7:
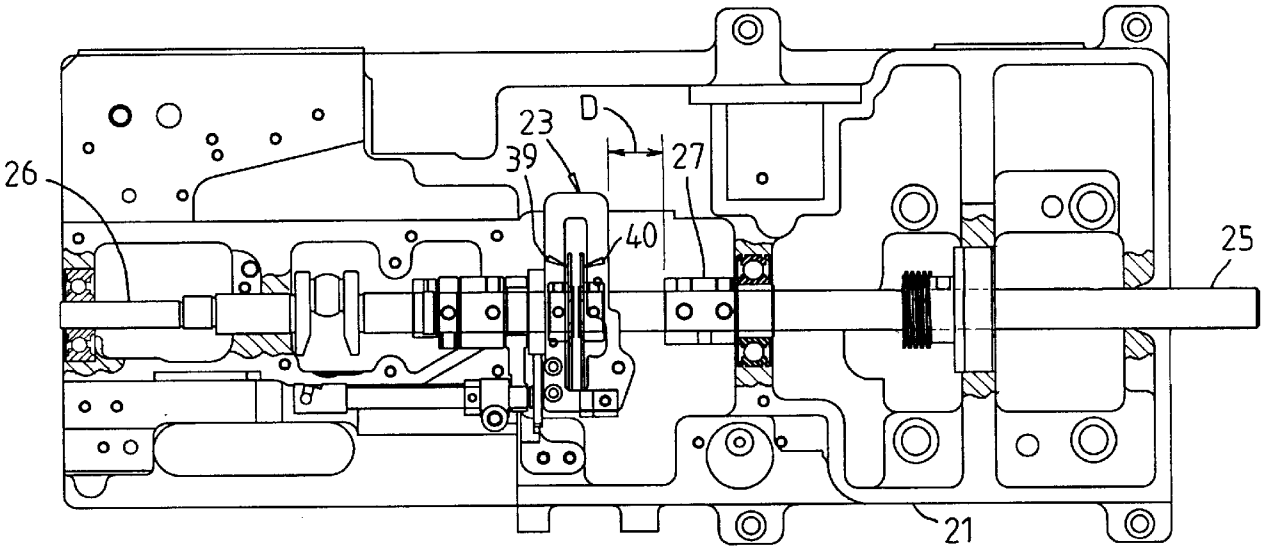
FIG. 7 is a sectional view taken along line 7—7 of FIG. 2.
Figure 8:
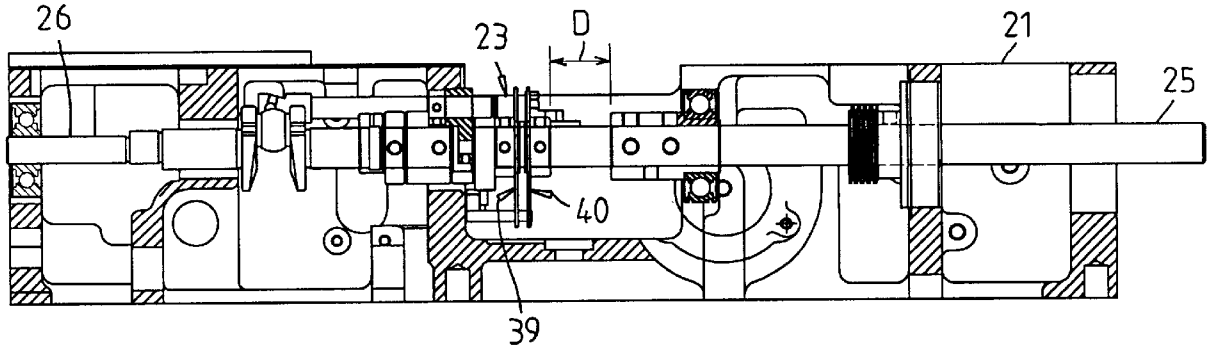
FIG. 8 is a sectional view taken along line 8—8 of FIG. 2.

Referring to FIGS. 1, 5 and 6, the guide plate 30 has an arched fixing slot 34. A bolt 45 is passed through the fixing slot 34 to lock the guide plate 30 on the lower housing 21. By means of changing the position of the guide plate 30 relative to the second lower rotary shaft 26, the positions of the eyelets 32, 33 on two sides of the slot 31 of the guide plate 30 relative to the take-up cam 46 are changeable so as to adjust the take-up timing.

Referring to FIGS. 1, 5 and 6, scales 44 are marked on one side of the fixing slot 34 of the guide plate 30 to indicate the position of the guide plate 30, whereby the take-up timing can be quickly and easily adjusted.

Referring to FIGS. 5 and 6, the lower housing 21 is provided with a bracket 35 having an arched guide section 36 which is locked on the lower housing 21 by means of screws 62. The circular center of the arched guide section 36 is preferably positioned at the axis 37 of the second lower rotary shaft 26. (It is also acceptable that the circular center of the arched guide section 36 is displaced from the axis of 37 of the second lower rotary shaft 26.) The guide plate 30 is slidable along the arched guide section 36 of the bracket 35, whereby the eyelets 32, 33 on two sides of the slot 31 of the guide plate 30 revolve in an arched track about the axis 37 of the second lower rotary shaft 26 so as to adjust the take-up timing.

According to the above arrangement, the present invention has the following advantages:

1. The slide interval D is defined between the looper thread take-up structure 23 and the shaft coupler 27. The first and second cam plates 39, 40 can slide along the second lower rotary shaft 26 to the slide interval D and respectively slide to two sides and separate from each other. Therefore, the tangling thread between the two cam plates 39, 40 can be easily cleared up.

2. The recess 61 is formed on a portion of the second lower rotary shaft 26 where the looper thread take-up structure 23 is fitted. A tool 38 can be extended into the recess 61 to cut off the thread 43 tangling around the second lower rotary shaft 26 so as to more easily clear up the tangling thread.

3. The take-up structure of the present invention is mounted in the lower housing 21 of the sewing machine in the original position. Therefore, the take-up structure is close to the lower knotting hook and a better take-up effect can be achieved.

4. The relative phase between the take-up cam and the second lower rotary shaft can be easily and quickly adjusted so as to achieve an optimal sewing effect.

5. Without any specialist skilled in sewing machine, a general sewer herself (generally female) can easily quickly complete the adjustment.

The above embodiments are only used to illustrate the present invention, not intended to limit the scope thereof. Many modifications of the above embodiments can be made without departing from the spirit of the present invention.

What is claimed is:

1. A sewing machine comprising:

(A) a lower housing;

(B) a first lower rotary shaft disposed in a section of the lower housing and drivingly connected with a power source;

(C) a second lower rotary shaft disposed in another section of the lower housing and drivingly connected with a lower stitching needle, the second lower rotary shaft being coaxial with the first lower rotary shaft;

(D) a shaft coupler for coupling the first lower rotary shaft with the second lower rotary shaft, whereby the first lower rotary shaft and the second lower rotary shaft are drivingly connected to rotate along with each other; and (E) a looper thread take-up structure fitted on the second lower rotary shaft, the looper thread take-up structure including:

(a) a thread guide including a guide plate formed with a slot and two eyelets respectively disposed on two sides of the slot, the guide plate having a fixing slot, a bolt being passed through the fixing slot to lock the guide plate on the lower housing, whereby by means of changing the position of the guide plate relative to the second lower rotary shaft, the positions of the eyelets on two sides of the slot of the guide plate relative to the take-up cam are changeable so as to adjust the take-up timing; and (b) a take-up cam fitted on the second lower rotary shaft and passed through the slot of the guide plate, the take-up cam including a first take-up cam plate and a second take-up cam plate, the first cam plate having an outer circumference and a shaft hole, by means of the shaft hole, the first cam plate being key-fitted on the second lower rotary shaft, the first cam plate being rotatable along with the second lower rotary shaft and axially slidable along the second lower rotary shaft, the second cam plate having an outer circumference and a shaft hole, by means of the shaft hole, the second cam plate being key-fitted on the second lower rotary shaft, the second cam plate being rotatable along with the second lower rotary shaft and axially slidable along the second lower rotary shaft, the first and second cam plates defining therebetween a gap and being separable from each other for easily clearing up tangling thread, a slide interval being defined between the looper thread take-up structure and the shaft coupler, whereby the second cam plate can slide along the second lower rotary shaft to the slide interval and separate from the first cam plate for easily clearing up the tangling thread.

2. The sewing machine as claimed in claim 1, wherein a recess is formed on a portion of the second lower rotary shaft where the looper thread take-up structure is fitted, whereby a tool can be extended into the recess to cut off the thread tangling around the second lower rotary shaft.

3. The sewing machine as claimed in claim 1, wherein scales are marked on one side of the fixing slot of the guide plate to indicate the position of the guide plate, whereby the take-up timing can be quickly and easily adjusted.

4. The sewing machine as claimed in claim 3, wherein the lower housing is provided with a bracket having an arched guide section, the circular center of the arched guide section being positioned at the axis of the second lower rotary shaft, the guide plate being slidable along the arched guide section of the bracket, whereby the eyelets on two sides of the slot of the guide plate revolve in an arched track about the axis of the second lower rotary shaft so as to adjust the take-up timing.

5. A sewing machine comprising:

(A) a lower housing;

(B) a first lower rotary shaft disposed in a section of the lower housing and drivingly connected with a power source;

(C) a second lower rotary shaft disposed in another section of the lower housing and drivingly connected with a lower stitching needle, the second lower rotary shaft being coaxial with the first lower rotary shaft;

(D) a shaft coupler for coupling the first lower rotary shaft with the second lower rotary shaft, whereby the first lower rotary shaft and the second lower rotary shaft are drivingly connected to rotate along with each other; and (E) a looper thread take-up structure fitted on the second lower rotary shaft, the looper thread take-up structure including:

(a) a thread guide including a guide plate formed with a slot and two eyelets respectively disposed on two sides of the slot; and (b) a take-up cam fitted on the second lower rotary shaft and passed through the slot of the guide plate, said sewing machine being characterized in that the take-up cam includes a first take-up cam plate and a second take-up cam plate, the first cam plate having an outer circumference and a shaft hole, by means of the shaft hole, the first cam plate being key-fitted on the second lower rotary shaft, the first cam plate being rotatable along with the second lower rotary shaft and axially slidable along the second lower rotary shaft, the second cam plate having an outer circumference and a shaft hole, by means of the shaft hole, the second cam plate being key-fitted on the second lower rotary shaft, the second cam plate being rotatable along with the second lower rotary shaft and axially slidable along the second lower rotary shaft, the first and second cam plates defining therebetween a gap and being separable from each other for easily clearing up tangling thread, a slide interval being defined between the looper thread take-up structure and the shaft coupler, whereby the second cam plate can slide along the second lower rotary shaft to the slide interval and separate from the first cam plate for easily clearing up the tangling thread.

6. The sewing machine as claimed in claim 5, wherein a recess is formed on a portion of the second lower rotary shaft where the looper thread take-up structure is fitted, whereby a tool can be extended into the recess to cut off the thread tangling around the second lower rotary shaft.

7. The sewing machine as claimed in claim 5, wherein the guide plate of the thread guide is movably connected with the lower housing, whereby y means of changing the position of the guide plate relative to the second lower rotary shaft, the positions of the eyelets on two sides of the slot of the guide plate relative to the take-up cam are changeable so as to adjust the take-up timing.

8. The sewing machine as claimed in claim 5, wherein the guide plate has a fixing slot, a bolt being passed through the fixing slot to lock the guide plate on the lower housing, whereby by means of changing the position of the guide plate relative to the second lower rotary shaft, the positions of the eyelets on two sides of the slot of the guide plate relative to the take-up cam are changeable so as to adjust the take-up timing.

9. The sewing machine as claimed in claim 5, wherein scales are marked on one side of the fixing slot of the guide plate to indicate the position of the guide plate, whereby the take-up timing can be quickly and easily adjusted.

10. The sewing machine as claimed in claim 9, wherein the lower housing is provided with a bracket having an arched guide section, the circular center of the arched guide section being positioned at the axis of the second lower rotary shaft, the guide plate being slidable along the arched guide section of the bracket, whereby the eyelets on two sides of the slot of the guide plate revolve in an arched track about the axis of the second lower rotary shaft so as to adjust the take-up timing.

* * * * *